US008850759B2

(12) United States Patent
Diether

(10) Patent No.: US 8,850,759 B2
(45) Date of Patent: Oct. 7, 2014

(54) WINDOW

(71) Applicant: Sven Diether, Moessingen (DE)

(72) Inventor: Sven Diether, Moessingen (DE)

( * ) Notice: Subject to any disclaimer, the term of this patent is extended or adjusted under 35 U.S.C. 154(b) by 0 days.

(21) Appl. No.: 13/783,600

(22) Filed: Mar. 4, 2013

(65) Prior Publication Data

US 2013/0232894 A1 Sep. 12, 2013

(30) Foreign Application Priority Data

Mar. 8, 2012 (DE) ..... 10 2012 101 947

(51) Int. Cl.

| | |
|---|---|
| ***E06B 3/68*** | (2006.01) |
| ***E06B 3/30*** | (2006.01) |
| ***E06B 3/36*** | (2006.01) |
| *E06B 3/44* | (2006.01) |

(52) U.S. Cl.

CPC ... *E06B 3/36* (2013.01); *E06B 3/30* (2013.01); *E06B 3/44* (2013.01)

USPC ..... 52/204.6; 52/204.593; 52/204.66; 52/204.1

(58) Field of Classification Search

USPC ..... 52/204.593, 204.6, 204.66, 204.1, 215, 52/786.1, 204.5; 49/176, 177, 182, 188, 49/189, 190, 192, 194, 195, 388, 390, 302, 49/398, 399, 400, 501, 504

See application file for complete search history.

(56) References Cited

U.S. PATENT DOCUMENTS

| | | | | | |
|---|---|---|---|---|---|
| 2,181,215 | A | * | 11/1939 | Sweany | 49/155 |
| 2,701,041 | A | * | 2/1955 | Toth | 52/208 |
| 2,965,935 | A | * | 12/1960 | Olsen | 49/450 |
| 3,777,846 | A | | 12/1973 | Josephson et al. | |
| 3,890,741 | A | * | 6/1975 | Johnson et al. | 49/162 |
| 4,237,654 | A | * | 12/1980 | Landem et al. | 49/141 |
| 5,850,710 | A | * | 12/1998 | Brock | 49/141 |
| 6,588,154 | B1 | * | 7/2003 | Miller et al. | 49/401 |
| 2007/0175118 | A1 | * | 8/2007 | Speyer et al. | 52/204.1 |

FOREIGN PATENT DOCUMENTS

| | | |
|---|---|---|
| DE | 87 07 433 | 7/1987 |
| EP | 0 816 621 | 1/1998 |
| GB | 2 188 357 | 9/1987 |
| GB | 2 302 123 | 1/1997 |
| GB | 2 320 941 | 7/1998 |
| GB | 2 485 549 | 5/2012 |

* cited by examiner

*Primary Examiner* — Brian Glessner
*Assistant Examiner* — Adam Barlow
(74) *Attorney, Agent, or Firm* — Michael J. Striker

(57) ABSTRACT

A window with at least one leaf, which may be swiveled around a vertical axis, has at least two glass panels arranged one above the other in a vertical direction. The leaf is configured so that one of the glass panels is offset forwards in relation to the other glass panel or panels in the line of sight when looking at the window from outside.

7 Claims, 5 Drawing Sheets

WINDOW

CROSS-REFERENCE TO A RELATED APPLICATION

The invention described and claimed hereinbelow is also described in German Patent Application DE 10 2012 101947.9, filed on Mar. 8, 2012. This German Patent Application, subject matter of which is incorporated herein by reference, provides the basis for a claim of priority of invention under 35 U.S.C. 119(a)-(d).

BACKGROUND OF THE INVENTION

The invention relates to a window that has all the characteristics of a casement window but the appearance of a sliding window.

Windows may be differentiated from each other with reference to various characteristics. If the possibility of opening a window is considered, sliding windows and casement windows may be differentiated from each other in particular. In the case of a sliding window, a part of the window may be moved in relation to a fixed or a second area of the window, which may be moved, in order to open the window. Vertical sliding windows are very widespread, particularly in the USA. Vertical sliding windows have the advantage that no space is needed in the room itself in order to open the window. If there are gusts of wind, there is no risk that the window will be damaged by a leaf of the window banging shut.

Vertical sliding windows, however, may be completely cleaned from outside only in the closed state. In the case of tall buildings, specialist companies with appropriate equipment, such as an outside lift for example, must be brought in to perform this task or so-called "washer bolts", to which a window cleaner may be hooked, must be fitted into the window frame in addition. For that matter, sliding windows are much more difficult to make windproof compared with casement windows, as leaves of a window (which may be moved), always require some room to move and, therefore, the necessary contact pressure is lacking in the closed state.

In the case of casement windows or tilt and turn windows, a leaf is provided that is swiveled around a horizontal and/or vertical axis, which may be opened inwards into the room as a rule. Cleaning the leaf of a window on the outside also presents no problem. However, in order to open the leaf of a window completely, it is necessary to have sufficient space inside the room. To address this requirement, the windows in Europe are frequently designed so that the leaves may be swiveled not only around a vertical axis, but also around a horizontal axis and brought into a tilting position. In the tilted state the risk of a window banging shut in the wind is also lower than in the case of a leaf, which is completely open. The room also may be ventilated and yet protection against intruders or rain may still be provided.

The type of window used also characterizes the appearance of the building. Buildings with vertical sliding windows are characterised by all the windows having a glazing bar dividing the glass, which runs crosswise more or less in the middle of the window. Therefore, as a rule, authorities for the protection of historic monuments require the type of window originally provided to be maintained in the historic building even in the case of restoration.

Therefore, it is not possible so far to replace a sliding window by a casement window in a house that is protected as a historic monument.

SUMMARY OF THE INVENTION

The present invention overcomes the shortcomings of known arts, such as those mentioned above.

The invention provides a window with all the characteristics of a casement window but an appearance of a sliding window and with which it is possible to replace sliding windows in houses protected as historic monuments without violating regulations on the protection of historic monuments.

In an embodiment, the window includes at least one leaf, which may be swiveled around a vertical axis, the leaf including at least two glass panels arranged one above the other in a vertical direction. One of the glass panels is offset forwards in relation to the other glass panel or panels in the line of sight when looking at the window from outside.

The window according to the invention has all the functions and characteristics of a casement window, such as the possibility of opening completely, closing tightly, the seals having no friction stress and the opening being larger in the open state, as well as the possibility of it being easy to clean the inside and the outside.

The fittings of casement windows also are more "burglar proof." Yet visually, at least on the outside, a sliding window is reproduced, in which not only a glazing bar dividing the glass (which runs horizontally) is provided between the various glass panels, but also one of the glass panels is offset forwards in relation to the other or others.

A building fitted with windows according to the invention, therefore, looks the same as a building with real vertical sliding windows even from close to.

In another embodiment, the window realizes an even better match to the appearance of a vertical sliding window may be achieved by forward offsetting the outside of the frame section of the leaf of the window (which surrounds the glass panel) in relation to the outside of the other frame section.

In the case of classic sliding windows, the bottom window section (which is enclosed by its own frame), is opened by moving upwards in relation to the fixed area of the window. Through this the frame of a sliding window (which surrounds the top area of the window), is offset forwards in relation to the frame of the area of the window, which may be moved when looking at the window from outside. This appearance is reproduced perfectly, if not only the glass panel, but also the outside of the frame sections (which frame the forwardly offset glass panel) is also offset forwards.

Unlike real sliding windows on the other hand, the inside of the whole frame of the leaf of a window may lie on one level and therefore have no steps. Such a flat frame on the inside may be cleaned more easily and produced more cheaply than a stepped frame. Of course the leaf of the window also may be able to be swiveled around a horizontal axis at least in a limited way. This allows that the leaf window also may be brought into a tilted position if it is desirable to have less air passing through than with the leaf open. In so doing, the horizontal axis may run preferably in the area of the lower edge of the leaf of the window.

There are particular advantages if at least one leaf of the window is fixed to a window frame, which is stepped on the side facing the window opening, and in the closed state the leaf of the window fits tightly to at least two surrounding areas arranged offset to each other in the base of the window opening.

This arrangement of the window frame and the leaf frame meets the standard of modern casement windows and may also be included in the window according to the invention.

The window according to the invention may be made of any material suitable for windows. That is, the leaf frame and/or the window frame of the inventive window may be made of wood, plastic, metal and/or a composite of these materials.

There are particular advantages if the frame and the window frame are made of aluminum on the outside and wood on the inside. When using such windows in regions with cold and rainy weather in particular, the aluminum outside of the window provides a weatherproof surface, whilst the wood inside produces a coszy character (which is desirable). The wood inside also prevents the cold coming into the room from outside through the aluminum.

The glass panels of the window according to the invention may be formed of at least two panes of glass arranged parallel to each other at a distance. Such double or even triple glazing guarantees the insulating and soundproofing values of the window, which are required in the case of modern buildings. Of course the windows according to the invention also may be provided with special glazing and all known devices for providing shade.

In an embodiment, the invention provides a window with at least one leaf that may be swiveled around a vertical axis and has at least two glass panels arranged one above the other, in which the outside of the frame section, which surrounds the top glass panel, is offset forwards in relation to the outside of the other frame sections in the line of sight when looking from outside.

This window has glass panels, which lie on one level, but a leaf frame, which is stepped on the outside in order to create the appearance of a vertical sliding window.

BRIEF DESCRIPTION OF THE DRAWINGS

Further features and advantages of the invention will become apparent from the description of embodiments that follows, with reference to the attached figures, wherein.

DETAILED DESCRIPTION OF THE INVENTION

The following is a detailed description of example embodiments of the invention depicted in the accompanying drawing. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1A:
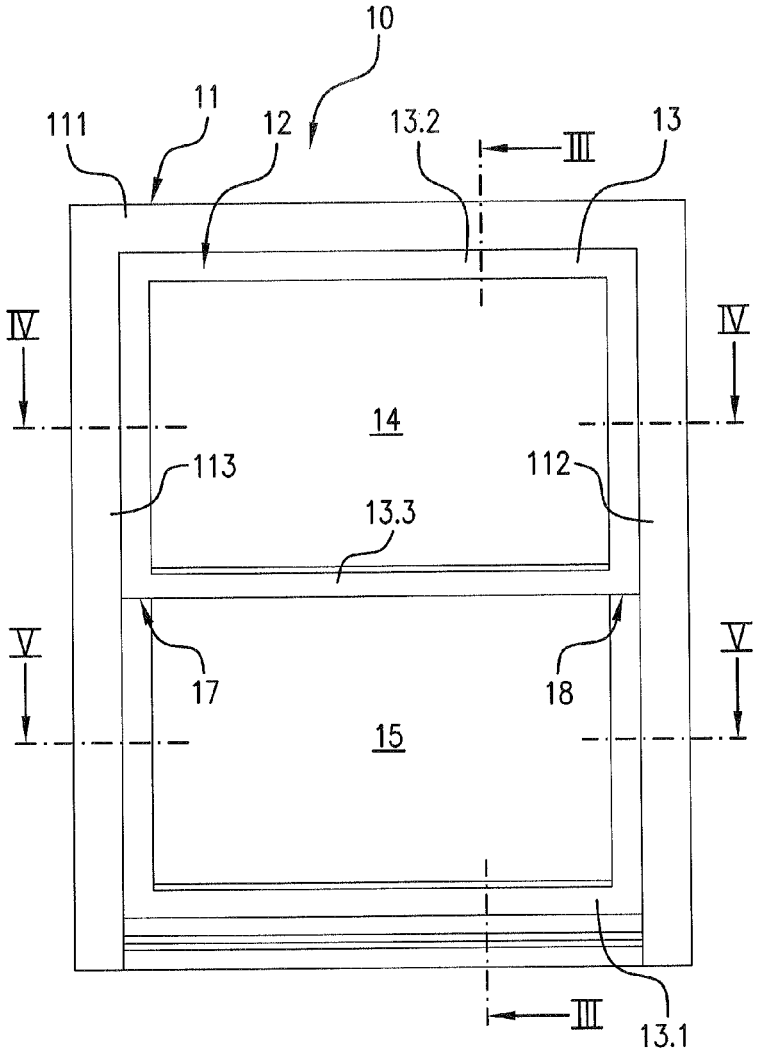
FIG. 1A a view of a window according to the invention from outside.
Figure 1B:
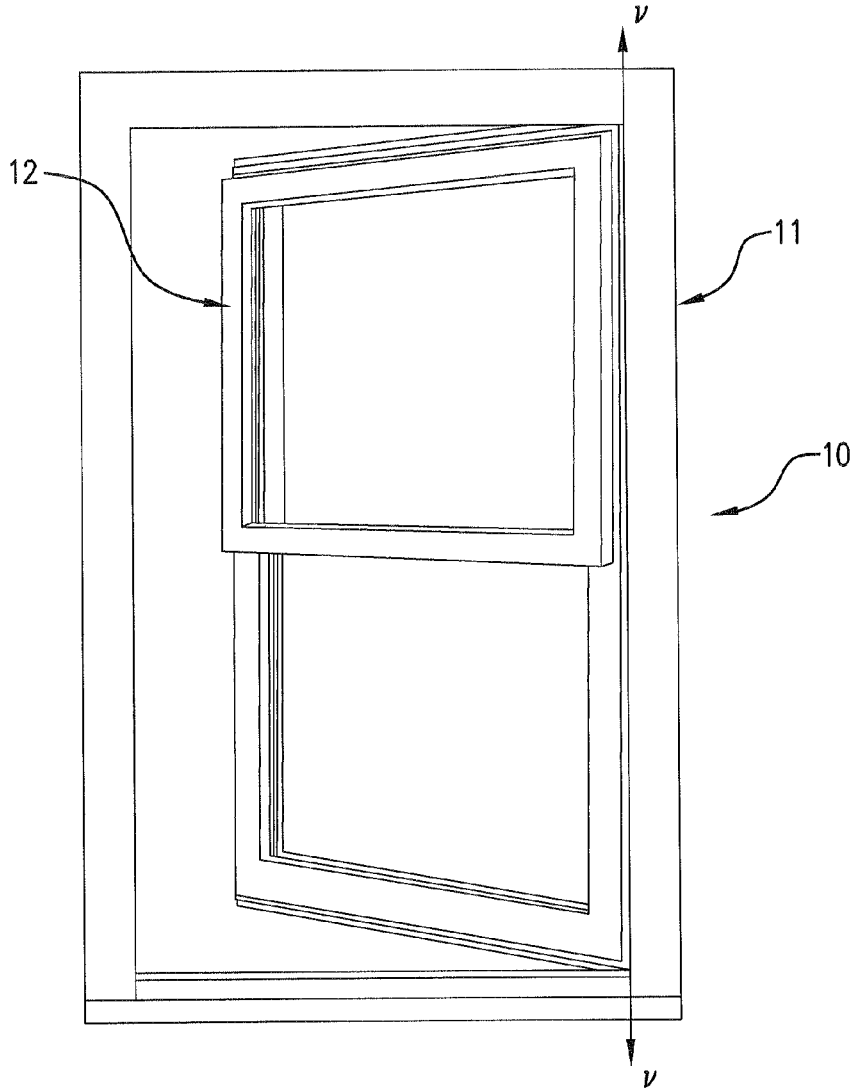
FIG. 1B a view of a window according to the invention from outside, as shown in FIG. 1A, highlighting that the leaf swiveling around a vertical axis.

FIG. 1A depicts a window 10 with a window frame 11 fitted into masonry (not illustrated in more detail here), to which a leaf 12 of the window 10 is fixed by hinges (not illustrated here). The leaf 12 of the window has a leaf frame 13, which is provided with two glass panels 14, 15. As the longitudinal section through the window 10 (according to FIG. 3) shows in particular, the glass panel 14 is offset forwards in relation to the glass panel 15 in the line of sight 16 when looking at the window 10 from outside. FIG. 1B depicts the window 10 shown in FIG. 1A to highlight that the leaf 12 swivels around a vertical axis v-v;

Through this, the visual impression of a vertical sliding window is achieved from outside. This visual impression is reinforced even more by the outside of the frame section 13.2, which surrounds the glass panel 14 and is offset forwards in relation to the frame section 13.1, which surrounds the bottom glass panel 15 on the sides and at the bottom. Through this, steps 17, 18 are created on the side arms of the leaf frame 13 under the glazing bar 13.3 dividing the glass. The steps reinforce even more the visual impression of two separate parts of the window, which are offset to each other.

Figure 2:
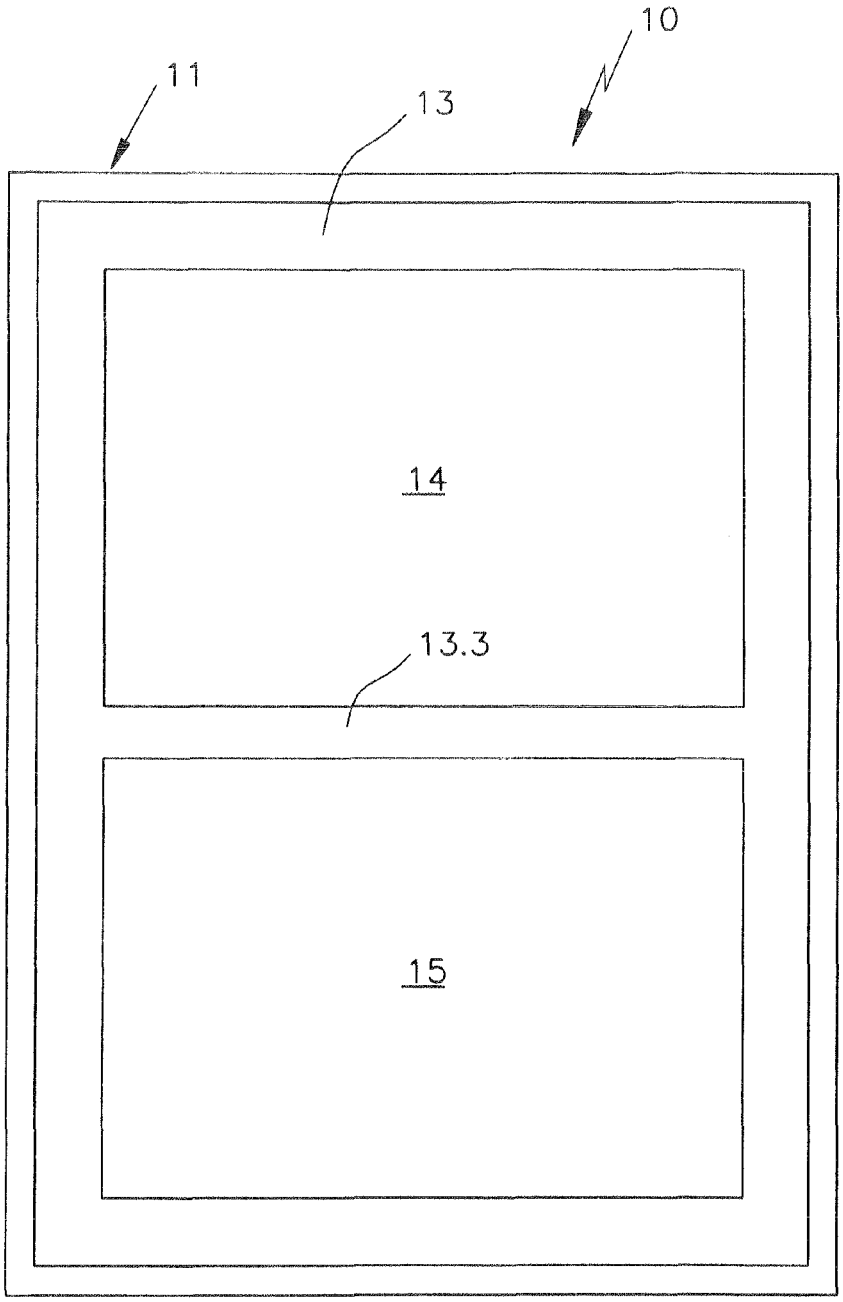
FIG. 2 a view of the window in FIG. 1 from inside.
Figure 3:
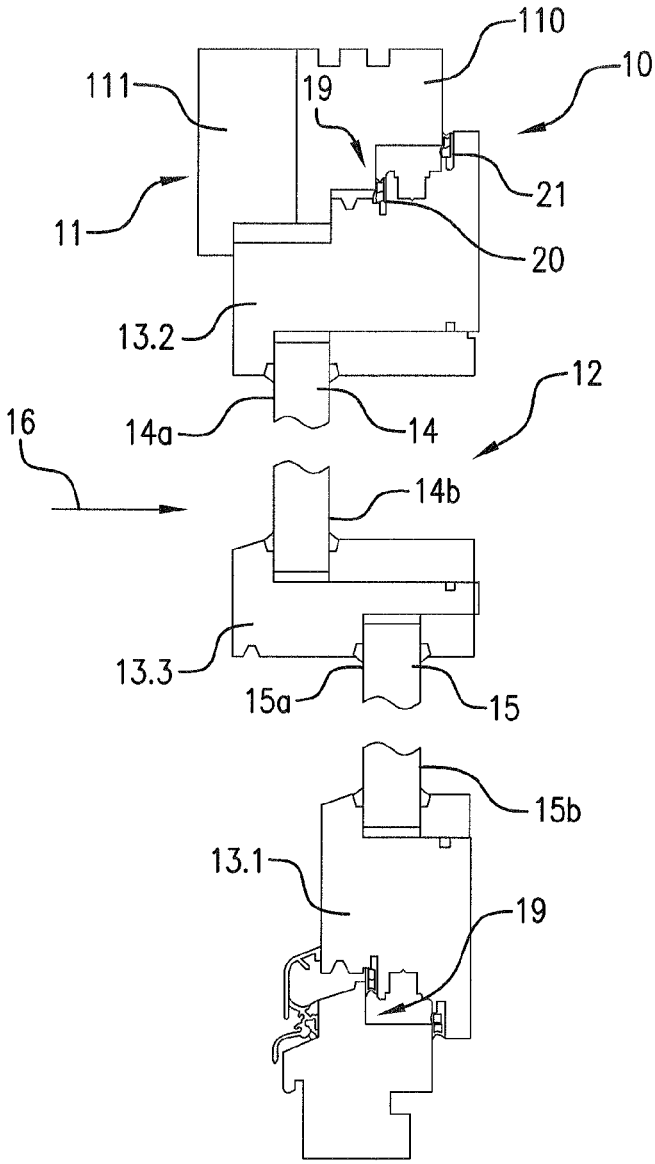
FIG. 3 a longitudinal section through the window in FIG. 1 along line III-III.

The inner view of the window 10 according to FIG. 2 and, the longitudinal section according to FIG. 3, together highlight that the frame 13 is not stepped on the inside for reasons of simpler production. Put another way, the inside of the frame 13 lies on one level. Through this from the inside the window 10 acquires more the character of a window with glazing bars and less that of a sliding window.

As the longitudinal section in FIG. 3 shows, the window frame is provided with a step 19 on the side pointing towards the window opening. This step 19 and the inside of the frame 11 therefore form two surrounding fixing areas for the leaf frame 13 of the leaf 12 of the window. The fixing areas are offset to each other in the direction 16, to which the leaf frame 13 fits tightly with seals 20, 21 in the closed state. FIG. 3 also highlights that glass panels 14 and 14 comprise two panes 14*a*, 14*b*, and 15*a*, 15*b*, respectively.

Figure 4:
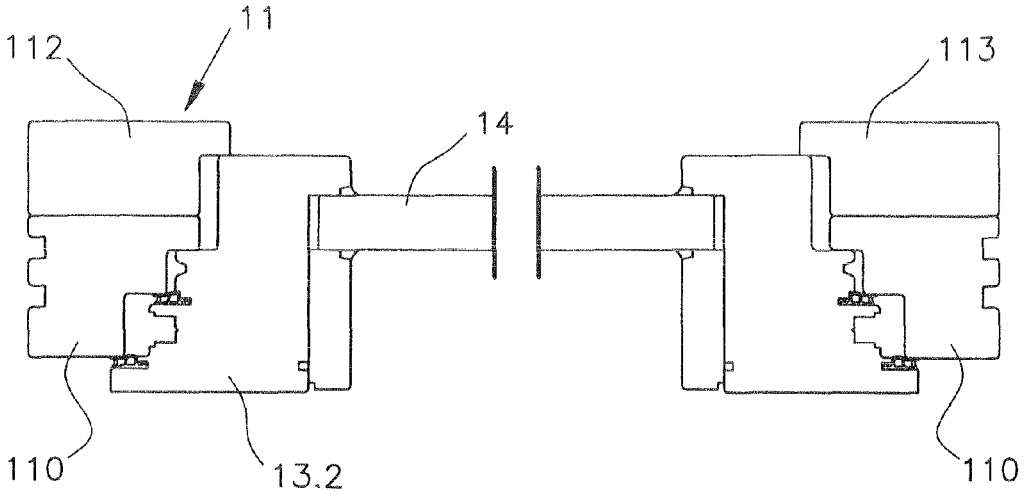
FIG. 4 a horizontal section through the window in FIG. 1 along line IV-IV.
Figure 5:
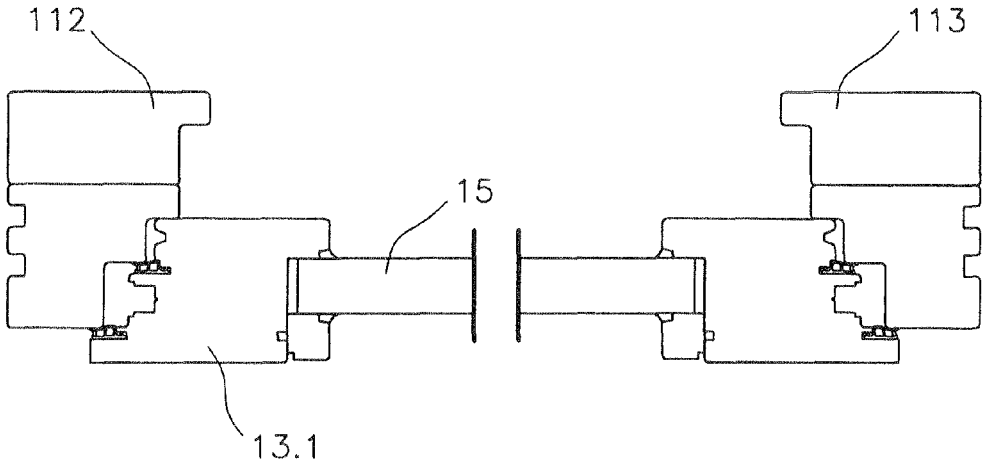
FIG. 5 a horizontal section through the window in FIG. 1 along line V-V.

The horizontal sections of FIGS. 4 and 5 clearly show the varying thickness of the leaf frame 13 in the area of the top glass panel 14 and in the area of the bottom glass panel 15. It may also be seen that the window frame 11 is reinforced in the area of the top horizontal arm and both its longitudinal arms by frame parts 111 (FIG. 3), 112, 113, which are added to a basic frame 110 from outside.

In the example illustrated, the window frame was produced from a basic frame 110 already available for an ordinary windows by adding the frame parts 111-113.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A window, comprising:

at least one leaf (12) configured to swivel around a vertical axis and including a single frame (13) with two glass panels (14, 15) immovably arranged one above the other in a vertical direction in the single frame, wherein one of the glass panels (14) is offset forwards in relation to the other glass panel (15) or panels (15) in a line of sight (16) when looking at the window (10) from outside wherein the frame includes an outside of the frame section that surrounds the glass panel that is offset forwards and other frame sections, and wherein the outside of the frame section is offset forwards in relation to the outside of the other frame sections.

2. The window according to claim 1, wherein an inside of the frame (13) of the leaf (12) lies on one plane.

3. The window according to claim 1, wherein the at least one leaf (12) is fixed to a window frame (11), wherein the window frame (11) is provided with a step (19) on a side facing the window opening, wherein the step (19) and an inside of the window frame (11) form two surrounding fixing areas for the leaf frame (13) that are arranged offset to each other in a base of the window opening and wherein the leaf (12) in the closed state fits tightly to the window frame (11) upon the two surrounding areas.

4. The window according to claim 3, wherein the window frame (11) is made of a basic frame (110), to the outside of which frame parts (111-113) are added for reinforcement above and at sides of the window opening.

5. The window according to claim 3, wherein the frame (13) and/or the window frame (11) is made of wood, plastic, metal and/or a composite of these materials.

6. The window according to claim 1, wherein the glass panels (14, 15) are made of at least two panes of glass arranged parallel to each other at a distance.

7. A window with at least one leaf, which may be swivelled around a vertical axis, the at least one leaf comprising:

two glass panels arranged one above the other in a vertical direction, and a frame section with an outside that surrounds the top glass panel and another frame section with an outside that surrounds the lower glass panel, wherein the outside frame section surrounding the top glass panel is offset forwards in relation to the other outside frame section in the direction of sight when looking at the window from outside, and wherein the frame sections are immovably arranged as a single frame.

* * * * *